US006677699B1

(12) United States Patent
Kuti

(10) Patent No.: US 6,677,699 B1
(45) Date of Patent: Jan. 13, 2004

(54) FILAMENT STRUCTURE FOR INCANDESCENT LAMPS

(75) Inventor: Ernö Kuti, Budapest (HU)

(73) Assignee: General Electric Company, Schenectady, NY (US)

( * ) Notice: Subject to any disclaimer, the term of this patent is extended or adjusted under 35 U.S.C. 154(b) by 167 days.

(21) Appl. No.: 09/712,330

(22) Filed: Nov. 14, 2000

(51) Int. Cl.[7] ..... H01K 1/18
(52) U.S. Cl. ..... 313/271; 313/274; 313/578
(58) Field of Search ..... 313/271, 274, 313/292, 578, 567; 439/558, 602, 605, 614, 699.2

(56) References Cited

U.S. PATENT DOCUMENTS

| | | | | |
|---|---|---|---|---|
| 1,695,600 A | * | 12/1928 | Metcalf | 313/271 |
| 3,524,693 A | * | 8/1970 | Kubo et al. | 445/27 |
| 3,854,180 A | * | 12/1974 | Pastijn et al. | 445/32 |
| 5,808,399 A | | 9/1998 | Yoneyama | |
| 6,808,399 | | 9/1998 | Yoneyama | 313/271 |

FOREIGN PATENT DOCUMENTS

| | | |
|---|---|---|
| JP | 04206337 | 7/1992 |
| JP | 04308651 | 10/1992 |

* cited by examiner

*Primary Examiner*—Edward J. Glick
*Assistant Examiner*—Elizabeth Gemmell
(74) *Attorney, Agent, or Firm*—Fay, Sharpe, Fagan, Minnich & McKee, LLP

(57) ABSTRACT

The filament structure comprises a filament with a coiled portion and an uncoiled portion. A tube is disposed on a free end of the uncoiled portion. The tube has two ends and a passage with a central axis extending between the two ends.

At least one of the ends comprises an extension which projects positively above a medium plane of the end of the tube. This medium plane is perpendicular to the central axis of the tube.

A method for positioning such a tube on the free end of a filament comprises the following steps. The free end of the filament is inserted in a slit between two parallel support surfaces so that the free end is projecting upward. The tube is placed on the free end of the filament so that the extension of the tube projects downward towards the support surfaces and the lower end of the tube abuts at least one of the support surfaces. The filament is advanced in the slit along the support surfaces resulting in rotation of the tube around the free end of the filament due at least in part to frictional forces arising between the extension of the tube and one of the support surfaces.

20 Claims, 5 Drawing Sheets

FILAMENT STRUCTURE FOR INCANDESCENT LAMPS

FIELD OF THE INVENTION

This invention relates to a filament structure, and, more particularly, to a filament structure which is suitable for use in incandescent lamps.

BACKGROUND OF THE INVENTION

Filaments for incandescent lamps generally comprise a filament with a coiled portion and an uncoiled portion where the coiled portion is the actual glowing part of the filament. The uncoiled portion of the filament is used for attaching the complete filament structure to a lead wire. For this purpose, it is known to place a tube on the free end of the uncoiled portion, and the tube is in turn welded to the lead wire. This procedure is necessary because the tungsten filament cannot be welded easily to the lead wire which is usually made of molybdenum. It is preferable if the tube is also made of molybdenum.

U. S. Pat. No. 5,808,399 discloses a method for fixing a filament onto a lead wire in an incandescent lamp. A molybdenum foil is used in this known method. The foil is wrapped around the free ends of the uncoiled portions of the filament and then squeezed together at its ends. The fin-like ends of the foil may come in the way of the welding electrodes which leads to inferior welding.

Instead of wrapped foils, it is also known to use tubes, which are pulled on the filament ends. Usually, the molybdenum tube is made of a strip material which is rolled into a tube. As a result, there is an axial slit in the mantle of the tube. The existence of the slit, and, more precisely, its positioning during the manufacturing process of the filament structure is a cause of certain problems. In the manufacturing process, the tube is pressed onto the uncoiled portion of the filament. If the tube comes between the pressing jaws in an unfavorable position, the slit may open too wide. If this wide slit rolls between the electrodes during the welding process, a substandard electrical contact arises between the filament and the tube since the welding machine is adjusted to weld (and melt) a pre-determined quantity of material. When a wide slit comes in the way of welding, the quantity of material to be welded will be smaller which leads to poor electrical contact.

Thus there is a particular need for a filament structure which alleviates the above negative effects and provides for positioning of the tube in order to accomplish a standard quality of welding.

BRIEF SUMMARY OF THE INVENTION

In an exemplary embodiment of the invention, a filament structure comprises a filament with a coiled portion and an uncoiled portion. The uncoiled portion of the filament is provided with a tube disposed on a free end of the uncoiled portion. The tube has a central axis and two ends. At least one end of the tube comprises an extension which projects positively above a medium plane of the end of the tube. This medium plane is perpendicular to the central axis of the tube. By the term "medium plane", it is indicated that this plane is approximately at an equal distance from the end points of the end of the tube.

A method for positioning a tube on the free end of a filament is also disclosed. In an exemplary performance of the method, the following steps are comprised.

The free end of a filament is inserted in a slit bet ween two parallel support surfaces so that the free end is projecting upward. The width of the slit is positively smaller than the diameter of the tube. There is provided an extension on an end of the tube, and the extension projects positively above a medium plane of the end of the tube. Said medium plane is perpendicular to a central axis of the tube. The tube is placed on the free end of the filament so that the free end of the filament is inserted in the tube substantially along the total length of the tube. In this position, the free end of the filament is substantially concentric with the central axis of the tube, and the extension of the tube projects downward towards the support surfaces. Due to the force of gravity, the lower end of the tube abuts at least one of the support surfaces. The filament is advanced in the slit along the support surfaces. During the movement of the filament, the tube is rotated around the free end of the filament by frictional forces arising between the extension of the tube and one of the support surfaces. The frictional forces arise upon the relative movement between the extension and the corresponding support surface.

This filament structure and method provide the advantage that the tube always arrives at the welding station in a well-defined position. Due to the substantially identical position of the tube, the slit of the tube can always avoid the way of welding. This results in a reliable and standard quality weld. A further advantage is that the proposed method does not require the use of sophisticated additional equipment, and may be readily applied to existing manufacturing facilities.

DETAILED DESCRIPTION OF THE INVENTION

Figure 1:
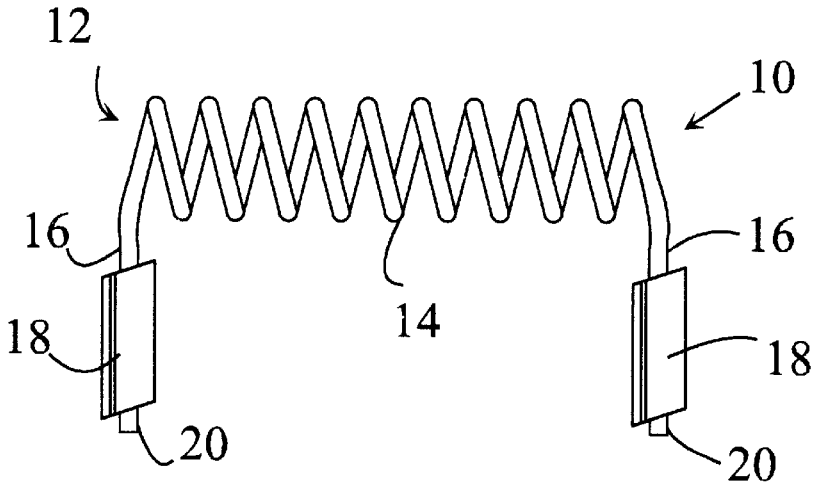
FIG. 1 is a side view of a filament structure in which the present invention is embodied.
Figure 2:
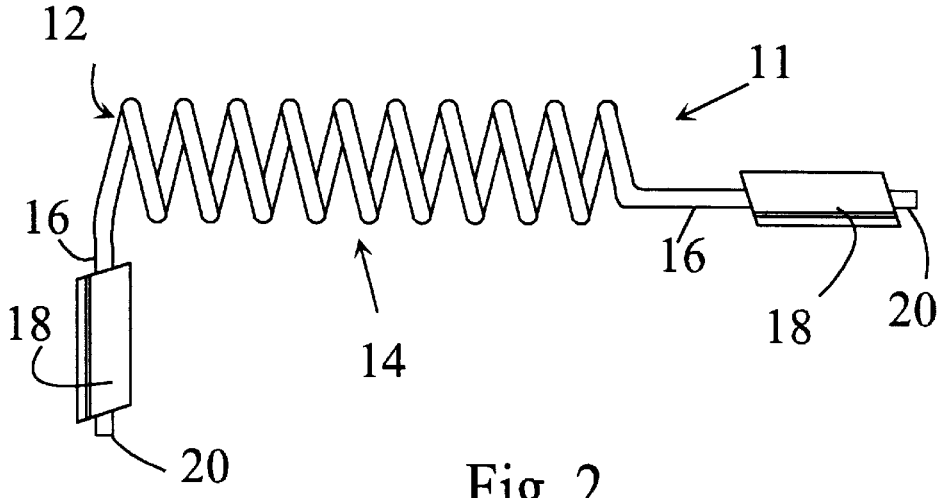
FIG. 2 is a side view of a further embodiment of the filament structure.

Referring now to FIGS. 1 and 2, there is shown a filament structure 10 which comprises a filament 12 with a coiled portion 14 and an uncoiled portion 16. Usually, the filament 12 is symmetric, as shown in FIG. 1, and there are two uncoiled portions 16 at each end of the coiled portion 14.

Alternatively, it is also customary that one of the uncoiled portions 16 is at an angle to the other uncoiled portion 16, e.g. substantially perpendicular, as shown on the filament structure 11 in FIG. 2. This arrangement is dependent on the specific application, i.e. the type of the incandescent lamp where the filament structure is to be used. Such lamps, e.g. halogen incandescent lamps for the headlights of automobiles, are well known and need not further explanation.

There is a tube 18 disposed on each of the uncoiled portions 16 of the filament 12, more precisely, on a free end 20 of the uncoiled portions 16.

The role of the tube 18 is explained above, i.e. the tungsten filament 12 is fastened to a lead wire by welding the tube 18 to the lead wire (not shown in FIGS. 1 and 2.)

The form and function of the tube 18 is explained with reference to FIGS. 3–7.

Figure 3:
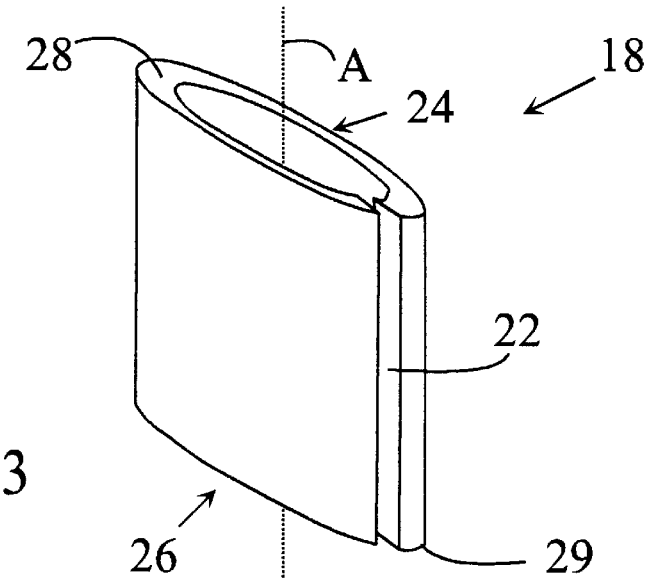
FIG. 3 is a perspective, enlarged view of a tube of the filament structure of FIG. 2.

Turning now to FIG. 3, there is shown a tube 18 of the filament structure 10 in an enlarged view. The tube 18 is normally made of molybdenum, and it is prepared from a sheet material, which is rolled together, resulting in a slit 22 along the mantle of the tube 18. The central axis A of the tube 18 is considered to be parallel with the generatrices of its barrel.

Figure 4:
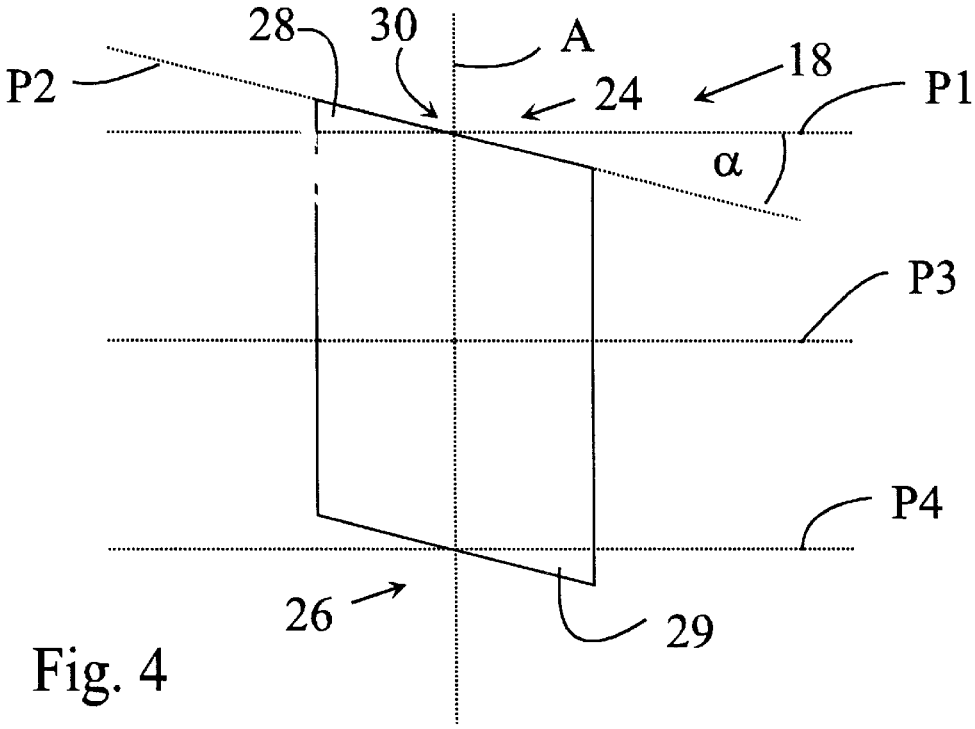
FIG. 4 is a schematic side view of the tube of FIG. 3.

The tube 18 has a first end 24 and a second end 26, the first end 24 shown upwards in FIG. 3. At least one end 24 of the tube 18 comprises an extension 28. This extension 28 projects positively above a medium plane P1 of the end 24 of the tube 18, i.e. the extension projects away from the tube 18 along the central axis A. The medium plane P1 is defined as a plane which is perpendicular to the central axis A of the tube as best seen in FIG. 4. By the term "medium plane", it is meant that the plane P1 is more or less in the "center of gravity" of all the end points of the tube 18 on the end 24. More precisely, the medium plane P1 intersects the central axis A of the tube 18 in a point 30 where the distance of the point 30 from the central perpendicular plane P3 of the tube is the average of the distances of all end points at the first end 24 from the central perpendicular plane P3. With other words, the extension 28 will be at the largest distance from the central perpendicular plane P3 of the tube 18.

Preferably, the other end 26 of the tube 18 is also provided with an extension 29. The extensions 28, 29 are substantially identical to each other for the reasons explained below. This means that the extension 29 is also positively projects above a medium plane P4 of the other end 26 of the tube 18 where the medium plane P4 is defined similarly to the medium plane P1 of the first end 24. Obviously, the extension 29 of the other end 26 projects downward in FIGS. 3 and 4.

In a particularly preferred embodiment, the ends 24, 26 of the tube 18 are cut at an acute angle. This means that the principal end plane P2 of the first end 24 is at an angle a to the perpendicular medium plane P1 so that the principal end plane P2 intersects the medium plane P1 of the corresponding tube end 24. In this case, the extension 28 is constituted by that part of the tube end 24 which projects in an outward direction relative to the corresponding medium plane P1. Clearly, the same applies for the extension 29 of the other tube end 26 which will be on the side of the corresponding medium plane P4 opposite to the bulk of the tube 18.

The value of the angle a between the medium plane P1 and the principal end plane P2 may be in the range of 10–40 degrees, preferably between 20–25 degrees.

Figure 6:
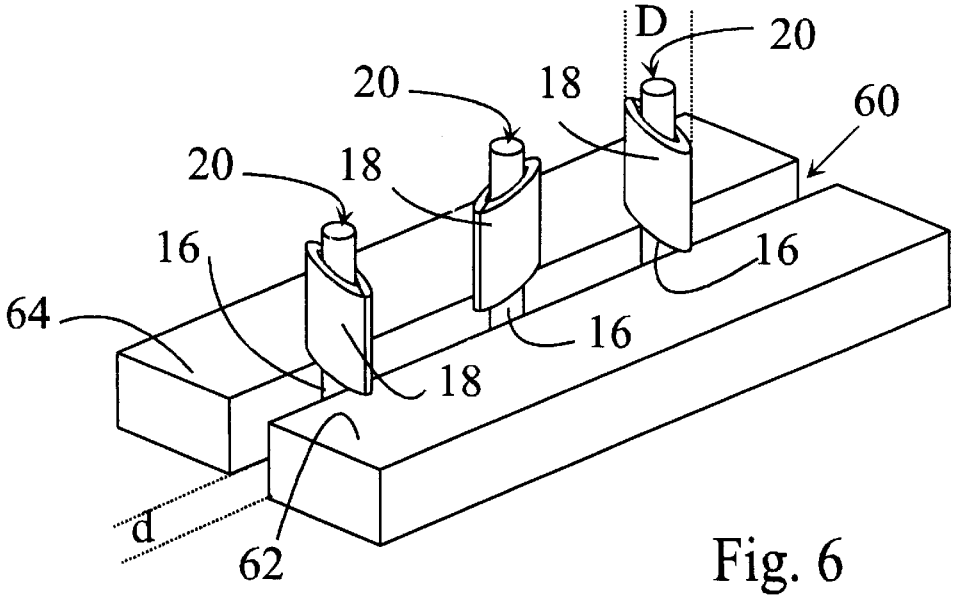
FIG. 6 illustrates a further step of the method of positioning the tube of FIG. 3.
Figure 7:
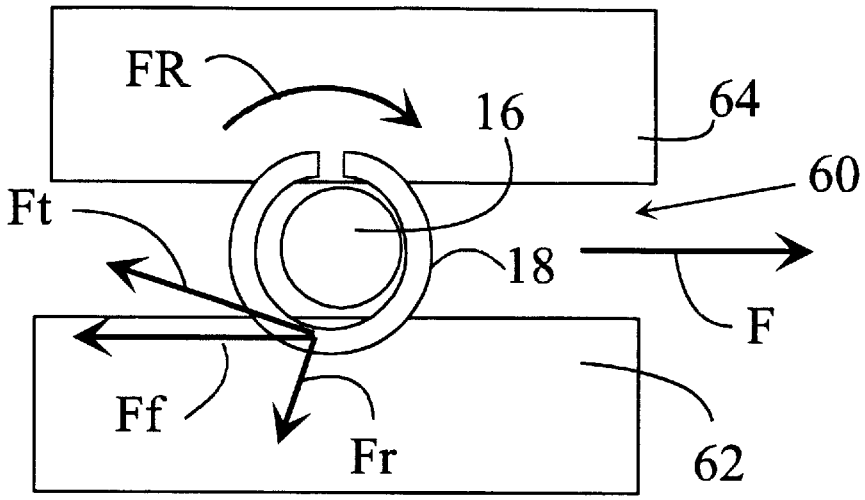
FIG. 7 is a schematic top view on a larger scale of the positioning arrangement of FIGS. 7 and 8.

The use of the tube 18 will be explained with reference to FIGS. 5 to 7 which illustrate the steps performed in a method in which another aspect of the present invention is embodied. The method concerns the positioning or, more precisely, the orientation of a tube on the free end of a filament, e.g. the proper orientation of the tubes 18 on the free ends 20 of the filaments 12 for the purposes of proper welding. Nevertheless, this method may be used for other purposes as well where correct positioning of a tube is needed. The method comprises the following steps.

Figure 5:
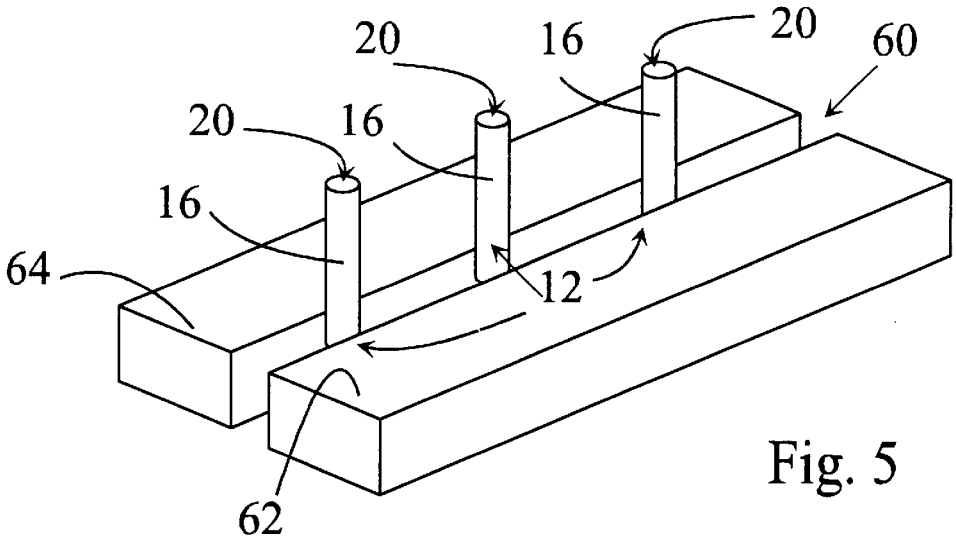
FIG. 5 illustrates a step of a method of positioning the tube of FIG. 3.

The free ends 20 of the filaments (only the uncoiled portion 16 thereof is shown) are inserted in a slit 60 between two parallel support surfaces 62, 64 so that the free end 20 is projecting upward as best seen in FIG. 5. The width d of the slit 60 is chosen to be positively smaller than the diameter D of the tube 18. This ensures that the tubes 18 will not fall in the slit 60 between the support surfaces 62, 64 when the tubes 18 are placed on the free ends 20 of the filaments 12.

The tubes 18 are provided with extensions 28, 29 on the ends as explained with reference to FIGS. 3 and 4, i.e. with extensions 28, 29 which project positively above a medium plane of the end of the tube. With other words, the extensions 28, 29 are protruding at the ends of the tubes 18 parallel to the central axis of the tubes 18.

The tubes 18 are placed on the uncoiled portions 16 sticking out from the slit 60 between the supporting surfaces 62, 64 so that the free ends 20 of the filaments 12 are inserted in the tubes 18 substantially along the total length of the tubes. In this position, the free ends 20 of the filaments 12 are substantially concentric with the central axis of the tubes 18. One of the extensions of the tube 18 projects downward, i.e. towards the support surfaces 62, 64. Since the tube 18 fits loosely on the uncoiled portions 16 of the filaments 12, the tubes 18 glide down completely along the uncoiled portions 16, and the lower end of the tubes 18 abuts at least one of the support surfaces 62, 64 as best seen in FIG. 6.

In this position, the filaments 12 are advanced in the slit 60 along 20 the support surfaces 62, 64. As a result, the tubes 18 are rotated around the free ends 20 of the filaments 12 by the frictional forces arising between the extension 28 or 29 of the tubes 18 and one of the support surfaces 62, 64.

The frictional forces arise because of the relative movement between the extensions 28, 29 and the corresponding support surface 62, 64 as it is explained with reference to FIG. 7.

The filaments 12 may be moved in the slit by various means, e.g. by vibration feeding. Assuming that the filaments 12 are moving in the direction F, a frictional force Ff arises between the supporting surface 62 or 64 and the tube 18. The frictional force arises where the tube 18 and the supporting surface 62 touch, i.e. at the lowest point of the tube 18. Due to the extensions 28, 29 on each end of the tube 18, there is provided a well-defined lowest point on the tube end. With other words, the tube 18 bears on the support surfaces by the extension 28 or 29.

The frictional force Ff may be regarded as composed of a tangential component Ft and a radial component Fr. The radial component Fr is countered by the uncoiled portion 16 of the filament 12 which acts as an axle and on which the tube 18 may rotate more or less freely. However, the tangential component Ft of the frictional force Ff is not compensated by other forces, and therefore this component will rotate the tube 18 in the direction indicated by FR.

It is apparent for those skilled in the art, that the tube 18 will rotate only as long as the forces on the tube 18 are not symmetric. As soon as the extension 28 or 29 is positioned after the filament (relative to the moving direction), the tube 18 will bear on both supporting surfaces 64, 62, and the rotating forces on the two sides will compensate each other. In this position the tube 18 will not rotate further but remains in a well-defined orientation.

The tubes 18 may be put on the free ends 20 of the filaments 12 in a number of ways. A possible method is the dropping of a large number of substantially identical tubes 18 on the free end 20 of the filament which latter protrudes upwards in the slit 60 between the support surfaces 62, 64. In practice, one of the tubes 18 will always fall on the free end of the filament 12.

Figure 8:
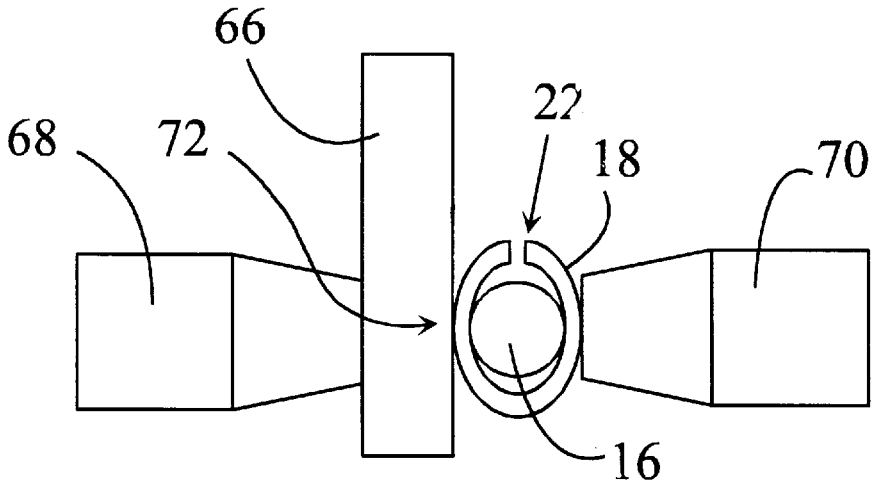
FIG. 8 is a schematic view of a welding process following the positioning of the tube on the filament.

The step following the orientation of the tubes 18 is illustrated in FIG. 8. In this step, the tube 18 is welded on a lead wire 66 between two electrodes 68, 70. It must be ensured that the slit 22 on the tube 18 is neither at the welding point 72 nor at the electrode 70 in order to achieve good quality, reliable welding. The method and the filament structure as proposed ensure that the tubes 18 always arrive at the welding station with a well-defined orientation.

Figure 9:
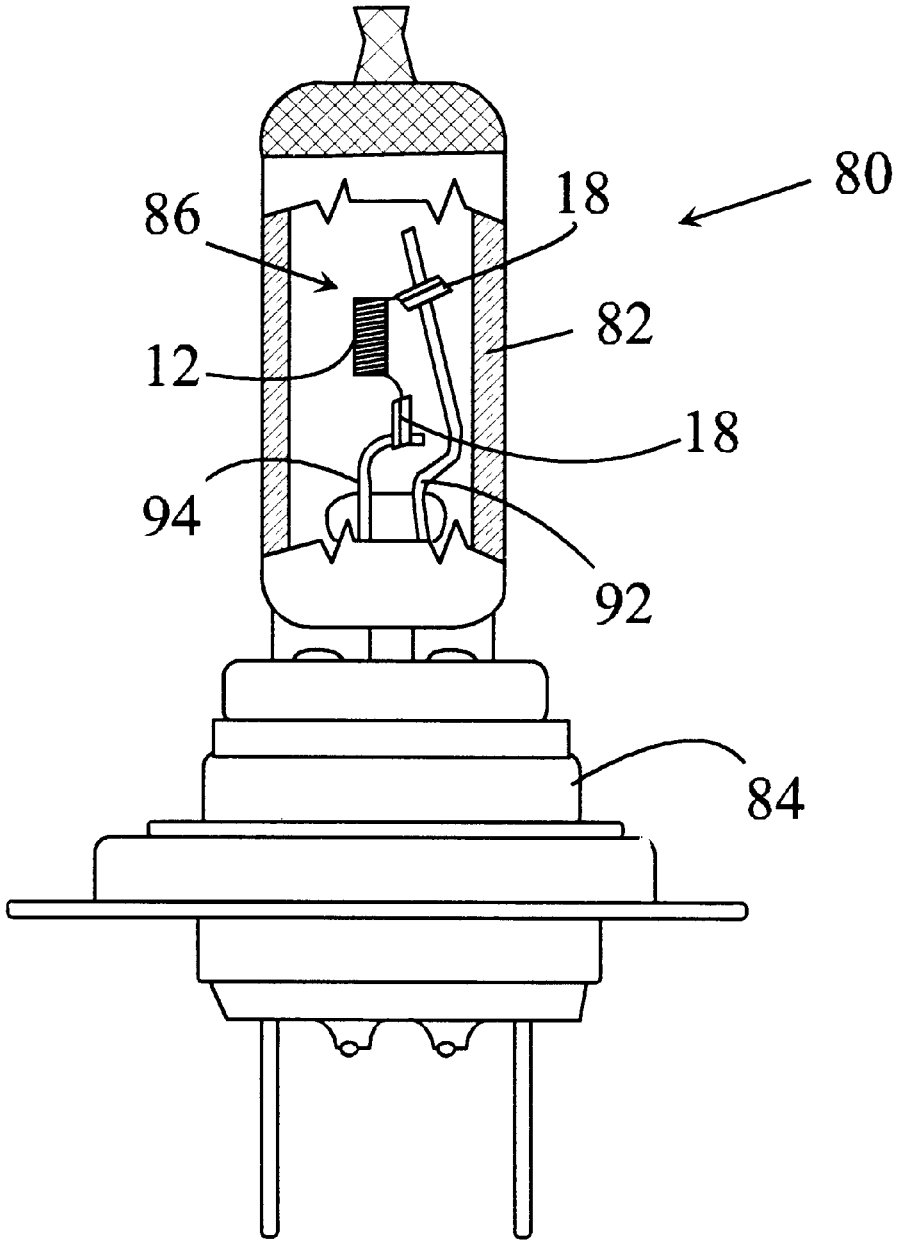
FIG. 9 is a side view of an incandescent lamp with a filament structure embodying the invention.

The filament structure proposed may be used advantageously in incandescent lamps, e.g. as the automotive lamp 80 shown in FIG. 9. The automotive lamp 80 is a halogen incandescent lamp with a glass bulb 82 fixed on a metal base 84. The bulb 82 encloses a filament structure 86 which latter is similar to the filament structure 11 shown in FIG. 2. The ends of the tungsten filament 88 are provided with tubes 18 which are identical to the tube 18 shown in FIG. 3. The filament 12 is welded to lead wires 92 and 94 with the help of the properly oriented molybdenum tubes 18. Thereby long lifetime and reliable operation of the lamp 80 is facilitated.

I claim:

1. A filament structure for incandescent lamps comprising:

a filament having a coiled portion and an uncoiled portion, a tube disposed on a free end of the uncoiled portion, the tube having two ends and an elongated slit extending between the two ends, the elongated slit having a longitudinally extending midline, at least one end of the tube comprising an extension projecting positively above a medium plane of the end of the tube, said medium plane being perpendicular to the midline of the elongated slit of the passage.

2. The filament structure of claim 1 in which a principal end plane of the end of the tube is at an angle to said medium plane so that said principal end plane intersects said medium plane, and the extension is constituted by a part of the end of the tube projecting in an outward direction relative to said medium plane.

3. The filament structure of claim 2 in which said principal end plane is at an angle of 10–40 degrees to said medium plane.

4. The filament structure of claim 3 in which said principal end plane is at an angle of 20–25 degrees to said medium plane.

5. The filament structure of claim 1 in which both ends of the tube comprise an extension.

6. The filament structure of claim 1 in which the tube comprises a passage having a central axis extending substantially parallel to the elongated slit.

7. An incandescent lamp comprising a filament structure, the filament structure comprising:

a filament having a coiled portion and an uncoiled portion, a tube disposed on a free end of the uncoiled portion, the tube having two ends and a passage with a central axis extending between the two ends, at least one end of the tube comprising an extension projecting positively above a medium plane of the end of the tube, said medium plane being perpendicular to the central axis of the tube.

8. An incandescent lamp according to claim 7, wherein the at least one end of the tube has a principal end plane extending at an angle to the medium plane so that the principal end plane intersects the medium plane, the extension including a portion of the end of the tube projecting in an outward direction relative to the end plane.

9. An incandescent lamp according to claim 8, in which a principal end plane of the end of the tube is at an angle to said medium plane so that said principal end plane intersects said medium plane, and the extension is constituted by a part of the end of the tube projecting in an outward direction relative to said medium plane.

10. An incandescent lamp according to claim 9, in which said principal end plane is at an angle of 10–40 degrees to said medium plane.

11. An incandescent lamp according to claim 8, in which said principal end plane is at an angle of 20–25 degrees to said medium plane.

12. An incandescent lamp according to claim 11, wherein the tube has an elongated slit extending between the two ends of the tube.

13. An incandescent lamp according to claim 12, wherein the elongated slit extends substantially parallel with the central axis of the passage.

14. An incandescent lamp according to claim 8, wherein the tube is formed from a sheet of molybdenum material.

15. An incandescent lamp according to claim 14, wherein the sheet of molybdenum material is molybdenum foil.

16. An incandescent lamp comprising:

an outer envelope at least partially defining a lamp chamber;

a filament disposed within the lamp chamber having a coiled portion and an uncoiled portion; and, a tube supported on the uncoilied portion of the filament, the tube having two ends and a passage with a central axis extending between the two ends, the tube having a medium plane extending substantially transverse the central axis, and means for orienting the tube relative to the uncoiled portion of the filament, the means of orienting extending axially outwardly beyond the medium plane.

17. An incandescent lamp according to claim 16, wherein the tube includes an elongated slit extending between the ends thereof.

18. An incandescent lamp according to claim 16, wherein the tube has a peripheral shape of a parallelogram having a plurality of included angles with at least one of the included angles being an acute angle.

19. An incandescent lamp according to claim 18, wherein the acute angle is from about 50 degrees to about 80 degrees.

20. An incandescent lamp according to claim 18, wherein the tube includes an elongated slit extending between the ends thereof, the slit extending substantially along one edge of the parallelogram shape.

* * * * *